US011946403B2

(12) United States Patent
Higgs, Jr.

(10) Patent No.: US 11,946,403 B2
(45) Date of Patent: Apr. 2, 2024

(54) MOTORIZED BICYCLE EXHAUST SYSTEM

(71) Applicant: Reginald Maceo Higgs, Jr., Palmetto, GA (US)

(72) Inventor: Reginald Maceo Higgs, Jr., Palmetto, GA (US)

( * ) Notice: Subject to any disclaimer, the term of this patent is extended or adjusted under 35 U.S.C. 154(b) by 0 days.

(21) Appl. No.: 17/808,960

(22) Filed: Jun. 24, 2022

(65) Prior Publication Data

US 2023/0417169 A1 Dec. 28, 2023

(51) Int. Cl.
*F01N 13/18* (2010.01)

(52) U.S. Cl.
CPC ..... *F01N 13/1855* (2013.01); *F01N 13/1805* (2013.01)

(58) Field of Classification Search
CPC ..... F01N 2590/04; F01N 13/1855; F01N 13/1805; F01N 2470/20; F01N 2470/30
See application file for complete search history.

(56) References Cited

U.S. PATENT DOCUMENTS 3,703,937 A * 11/1972 Tenney ..... F01N 1/165 60/314
5,044,159 A 9/1991 Landfahrer et al.
5,674,461 A * 10/1997 Kato ..... F01N 13/009 422/177
5,785,014 A 7/1998 Cornwell
6,901,753 B1 * 6/2005 Puzey ..... F01N 13/08 60/322
9,010,099 B2 4/2015 Schultz
2002/0152748 A1 * 10/2002 Matsuzawa ..... F01N 13/1805 60/323
2018/0111474 A1 * 4/2018 Yamashita ..... F01N 13/00
2019/0225313 A1 * 7/2019 Anderson ..... F01N 13/1855
2020/0182141 A1 * 6/2020 Buchwitz ..... F01N 13/10

FOREIGN PATENT DOCUMENTS

JP 55137307 A * 10/1980 ..... F01N 2590/04
JP 05248235 A * 9/1993 ..... F01N 2590/04

OTHER PUBLICATIONS

Gordon Jennings; "Two-Stroke Tuner's Handbook"; © 1973; Compiled for reprint © 2007 by Ken; p. 64.
Michael Forrest; "How a Two Stroke Expansion Chamber Works"; (no date provided); 11 pages.

* cited by examiner

*Primary Examiner* — David Bochna
(74) *Attorney, Agent, or Firm* — BakerHostetler

(57) ABSTRACT

Disclosed are exhaust systems for two-stroke engines mounted on bicycles. The exhaust systems include an expansion chamber having a divergent portion and convergent portion. The expansion chambers have different dimensions for the divergent portion and the convergent portion. The exhaust systems improve the power performance of the two-stroke engines operating at below maximal RPM by between about 15% and about 85% when compared to that of the two-stroke engines equipped with a stock exhaust pipe.

26 Claims, 6 Drawing Sheets

MOTORIZED BICYCLE EXHAUST SYSTEM

TECHNICAL FIELD

Describes herein are exhaust systems for motorized bicycles.

BACKGROUND

Motorized bicycles are becoming commonly used throughout the world. The majority of motorized bicycles either use electrically powered motors, or two-stroke internal combustion engines, mounted onto bicycle frames. The performance of two-stroke engines is often suboptimal, due to the incomplete combustion of the fuel. There are several ways to improve two-stroke engine performance, including boosting the compression at top revolutions per minute (RPM) for a faster burn and more power. Exhaust systems attached to the exhaust port of two-stroke engines can boost compression by creating reverse waves (returning to the cylinder) that happen from the main pressure wave in it expanding and then contracting at the divergent cone (diffuser cone) and convergent cone (baffle cone). The design and dimensions of such exhaust systems, as well as the distance of the divergent cone and convergent cone from the engine, can vary engine performance. So far, commercially available designs of the various motorized bicycle expansion chambers have not allowed stock and modified motorized bicycle engines to achieve optimal efficiency and maximum torque and horsepower throughout the engine's entire RPM range.

There remains a need for exhaust systems that maximize and improve the performance of two-stroke engines.

SUMMARY

In addressing these needs, the present disclosure provides improved exhaust systems.

The disclosed exhaust systems may comprise a first end and a second end. The disclosed exhaust systems may comprise the following components, which in some embodiments may be in the following sequential order:

- a flange at the first end of the exhaust system;
- a header adjacent to the flange;
- a curved portion adjacent to the header;
- an expansion chamber comprising a front end and a back end, wherein the expansion chamber is adjacent to the curved portion at the front end; and
- a stinger adjacent to the back end of the expansion chamber.

The expansion chamber can comprise a divergent portion at the front end, a belly about the center of the expansion chamber, and a convergent portion at the back end. The convergent portion can comprise a truncated cone shape and an angle (θ) at the vertex (V) of between about 15° and about 30°.

The expansion chamber can be segmented. The expansion chamber can be segmented and comprise multiple segments welded together. Each one of the header, the curved portion, the expansion chamber, and the stinger of the disclosed exhaust systems can be a hollow chamber. Each one of the header, the curved portion, the expansion chamber, and the stinger of the disclosed exhaust systems can be a hollow chamber free of (i.e., does not contain) additional chamber(s) within the chamber.

Also provided are methods of improving the performance of a two-stroke engine, such as a China Doll PK80 66 cc/80 cc engine or a 70 cc hybrid engine. The methods comprise attaching to the exhaust port of a two-stroke engine any one of the disclosed exhaust systems. The attachment can comprise linking the flange of the exhaust system to the exhaust port of the engine. In some aspects, the two-stroke engine can be mounted on a bicycle. The disclosed exhaust systems can improve the power performance of two-stroke engines, such as China Doll PK80 66 cc/80 cc engine or a 70 cc hybrid engine, operating at below maximal RPM by between about 15% and about 85% when compared to that of the two-stroke engines equipped with an exhaust pipe.

BRIEF DESCRIPTION OF THE DRAWINGS

The summary, as well as the following detailed description, is further understood when read in conjunction with the appended drawings. For the purpose of illustrating the disclosed exhaust systems, there are shown in the drawings exemplary embodiments of the methods; however, the disclosed exhaust systems are not limited to the exemplary embodiments of the methods. In the drawings.

DETAILED DESCRIPTION OF ILLUSTRATIVE EMBODIMENTS

Definitions

Figure 1:
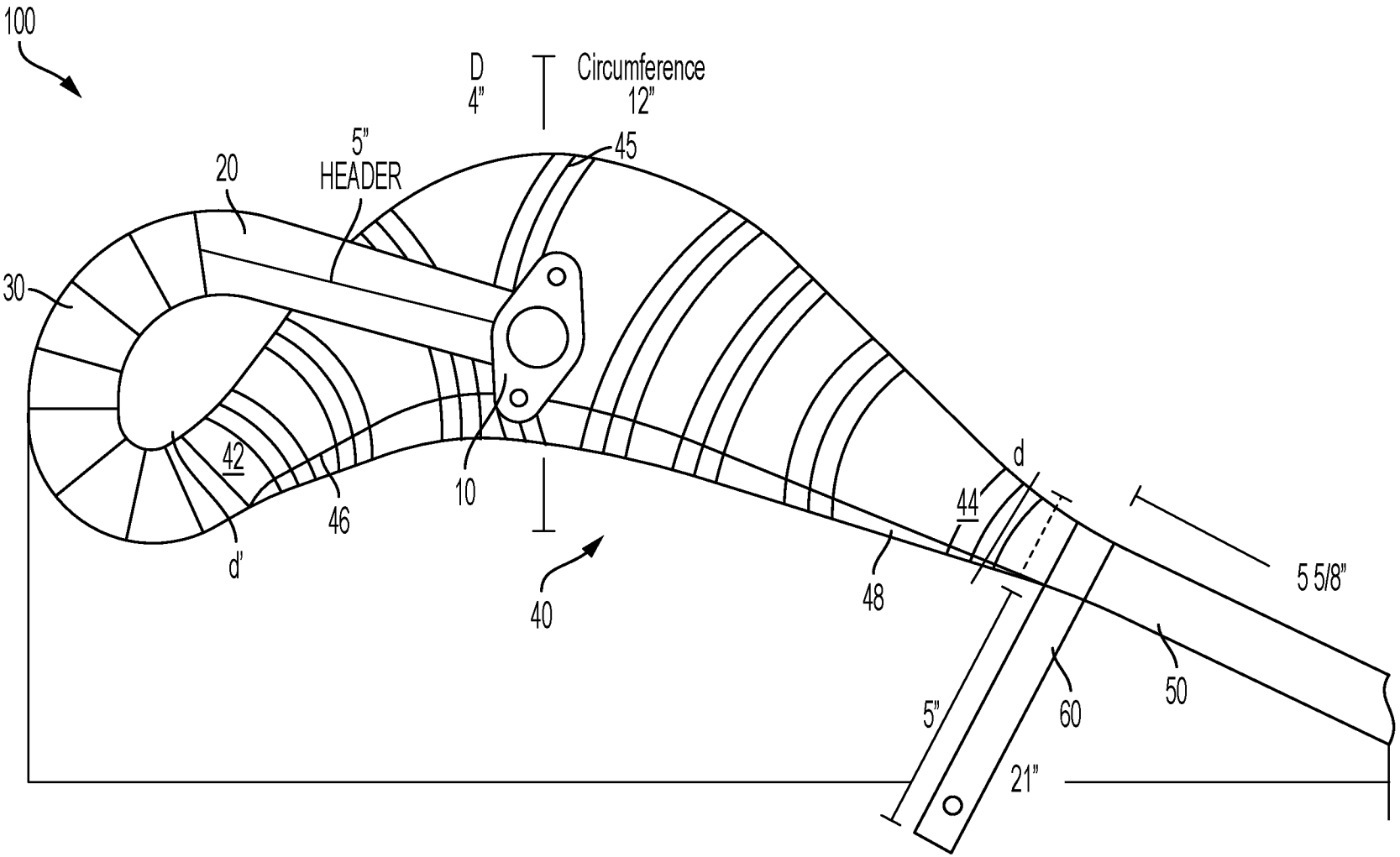
FIG. 1 is a diagram depicting an embodiment of the disclosed exhaust system.

The disclosed exhaust systems may be understood more readily by reference to the following detailed description taken in connection with the accompanying figures, which form a part of this disclosure. It is to be understood that the disclosed exhaust systems are not limited to the specific exhaust systems described and/or shown herein, and that the terminology used herein is for the purpose of describing particular embodiments by way of example only and is not intended to be limiting of the claimed exhaust systems and methods.

Throughout this text, the descriptions refer to exhaust systems and methods of using said exhaust systems. Where the disclosure describes or claims a feature or embodiment associated with an exhaust system, such a feature or embodiment is equally applicable to the methods of using said exhaust system. Likewise, where the disclosure describes or claims a feature or embodiment associated with a method of using an exhaust system, such a feature or embodiment is equally applicable to the exhaust system.

It is to be appreciated that certain features of the disclosed exhaust systems which are, for clarity, described herein in the context of separate embodiments, may also be provided in combination in a single embodiment. Conversely, various features of the disclosed exhaust systems and methods that are, for brevity, described in the context of a single embodiment, may also be provided separately or in any subcombination.

Various terms relating to aspects of the description are used throughout the specification and claims. Such terms are to be given their ordinary meaning in the art unless otherwise indicated. Other specifically defined terms are to be construed in a manner consistent with the definitions provided herein.

Unless otherwise defined, all technical and scientific terms used herein have the same meaning as commonly understood by one of ordinary skill in the art. In case of conflict, the present document, including definitions, will control. Preferred exhaust systems, methods and materials are described below, although exhaust systems, methods and materials similar or equivalent to those described herein can be used in practice or testing. The exhaust systems, methods, and examples disclosed herein are illustrative only and not intended to be limiting.

As used herein, the term "adjacent" or "adjacent to" refers to a position of one element relative to another. For example, term "adjacent" can refer to "next to", "attached", "connected", "extending from", "linked to," or "merged with." The term "adjacent" can refer to two or more elements attached or linked together via molding, welding, bolting, printing, fitting, sliding, and other such forms of attachment of one element to another.

As used herein, the term "substantial" or "substantially" refers to a degree of similarity, difference, increase, or decrease, as in a comparison to a known value. Substantial can include at least about 60%, at least about 65%, at least about 70%, at least about 75%, at least about 80%, at least about 85%, at least about 90%, at least about 91%, at least about 92%, at least about 93%, at least about 94%, at least about 95%, at least about 96%, at least about 97%, at least about 98%, or at least about 99% similarity, difference, increase, or decrease, as in a comparison to a known value.

It is understood that sizes, dimensions, parameters, and other quantities and characteristics are not and need not be exact, but can be approximate and/or larger or smaller, as desired, reflecting tolerances, conversion factors, rounding off, measurement error and the like, and other factors known to those of skill in the art. In general, size, dimension, parameter or other quantity or characteristic is "about" or "approximate" whether or not expressly stated to be such. It is understood that where "about" is used before a quantitative value, the parameter also includes the specific quantitative value itself, unless specifically stated otherwise. The term "about" as used herein when referring to a measurable value such as horsepower and the like, is meant to encompass variations of ±10%, ±5%, ±10%, or ±0.1% from the specified value, as such variations are appropriate to perform the disclosed methods. The modifier "about" should also be considered as disclosing the range defined by the absolute values of the two endpoints. For example, the expression "between about 2 and about 4" also discloses the range "from about 2 to about 4" and includes the values "2" and "4." The term "about" may refer to plus or minus 10% of the indicated number. For example, "about 10%" may indicate a range of 9% to 11%, and "about 1" may mean from 0.9-1.1. Other meanings of "about" may be apparent from the context, such as rounding off, so, for example "about 1" may also mean from 0.5 to 1.4.

As used herein, approximating language may be applied to modify any quantitative representation that may vary without resulting in a change in the basic function to which it is related. All ranges are combinable.

Further, the term "comprising" should be understood as having the open-ended meaning of "including," but the term also includes the closed meaning of the term "consisting." For example, a composition that comprises components A and B may be a composition that includes A, B, and other components, but may also be a composition made of A and B only.

As used in this specification and the appended claims, the singular forms "a," "an," and "the" include plural referents unless the content clearly dictates otherwise.

Exhaust Systems

The disclosed exhaust systems can comprise a first end and a second end. The disclosed exhaust systems can comprise a flange at the first end of the exhaust system. The disclosed exhaust systems can comprise a header adjacent to the flange. The disclosed exhaust systems can comprise a curved portion adjacent to the header. The disclosed exhaust systems can comprise an expansion chamber comprising a front end and a back end. The expansion chamber can be adjacent to the curved portion at the front end of the expansion chamber. The disclosed exhaust systems can comprise a stinger adjacent to the back end of the expansion chamber.

The Header

The disclosed exhaust systems can comprise a header. The header can comprise a straight hollow tube. The header can have a length of about 25 cm or less. The header can be comprised of a single piece. The header can be comprised of two or more pieces slip fitted together. The header can be comprised of two or more pieces slip fit with springs.

In some embodiments, the header comprises a straight hollow tube having a length between about 5 cm and about 25 cm. For example, the header can comprise a length between about 5 cm and about 25 cm. The header can comprise a length between about 5 cm and about 20 cm. The header can comprise a length between about 5 cm and about 15 cm. The header can comprise a length between about 10 cm and about 15 cm. The header can comprise a length of about 5 cm. The header can comprise a length of about 6 cm. The header can comprise a length of about 7 cm. The header can comprise a length of about 8 cm. The header can comprise a length of about 9 cm. The header can comprise a length of about 10 cm. The header can comprise a length of about 11 cm. The header can comprise a length of about 12 cm. The header can comprise a length of about 13 cm. The header can comprise a length of about 14 cm. The header can comprise a length of about 15 cm. In some aspects, the header can comprise a length of about 12.5 cm.

The header can comprise an inner diameter between about 25 mm and about 50 mm. For example, the header can comprise an inner diameter between about 25 mm and about 45 mm. The header can comprise an inner diameter between about 25 mm and about 40 mm. The header can comprise an inner diameter between about 25 mm and about 35 mm. The header can comprise an inner diameter between about 25 mm and about 30 mm. The header can comprise an inner diameter of about 26 mm. The header can comprise an inner diameter of about 28 mm. The header can comprise an inner diameter of about 30 mm. The header can comprise an inner diameter of about 32 mm. The header can comprise an inner diameter of about 34 mm. In some aspects, the header can comprise an inner diameter of about 28 mm.

The Curved Portion

The disclosed exhaust systems can comprise a curved portion. The curved portion can be segmented. The curved portion can be segmented and comprise multiple segments welded together. The curved portion can comprise welded joints. The welded joints can be positioned perpendicular to the longitudinal axis of the curved portion. The segments can comprise pie cut outs from an elongated tube. The elongated tube can comprise about the same diameter along the tube length. The curved portion can comprise a length between about 20 cm and about 50 cm. The curved portion can comprise a length between about 25 cm and about 50 cm. The curved portion can comprise a length between about 25 cm and about 45 cm. The curved portion can comprise a length between about 25 cm and about 40 cm. The curved portion can comprise a length between about 25 cm and about 35 cm. The curved portion can comprise a length between about 25 cm and about 30 cm. The curved portion can comprise a length of about 20 cm. The curved portion can comprise a length of about 25 cm. The curved portion can comprise a length of about 28 cm. The curved portion can comprise a length of about 30 cm. The curved portion can comprise a length of about 35 cm. The curved portion can comprise a length of about 40 cm. The curved portion can comprise a length of about 45 cm. The curved portion can comprise a length of about 50 cm. In some aspects, the curved portion can comprise a length of about 28 cm.

The curved portion can comprise an inner diameter substantially the same as the inner diameter of the header. For example, the curved portion can comprise an inner diameter between about 25 mm and about 50 mm. The curved portion can comprise an inner diameter between about 25 mm and about 45 mm. The curved portion can comprise an inner diameter between about 25 mm and about 40 mm. The curved portion can comprise an inner diameter between about 25 mm and about 35 mm. The curved portion can comprise an inner diameter between about 25 mm and about 30 mm. The curved portion can comprise an inner diameter of about 26 mm. The curved portion can comprise an inner diameter of about 28 mm. The curved portion can comprise an inner diameter of about 30 mm. The curved portion can comprise an inner diameter of about 32 mm. The curved portion can comprise an inner diameter of about 34 mm. In some aspects, the curved portion can comprise an inner diameter between about 25 mm and about 35 mm.

The Expansion Chamber

The expansion chamber can comprise a front end and a back end. The expansion chamber can comprise a divergent portion. The divergent portion can be at the front end of the expansion chamber. The expansion chamber can comprise a belly. The belly can be at about the center from the front end to the back end of the expansion chamber. The expansion chamber can comprise a convergent portion. The convergent portion can be at the back end of the expansion chamber.

The expansion chamber can be segmented. The expansion chamber can be segmented and comprise multiple segments welded together. The expansion chamber can comprise welded joints. The welded joints can be positioned perpendicular to the longitudinal axis of the expansion chamber. The expansion chamber can comprise a diameter (d') at the front end of the expansion chamber. The expansion chamber can comprise a diameter (D) at about the center of the expansion chamber. The expansion chamber can comprise a diameter (d') at the back end of the expansion chamber.

The expansion chamber can comprise a diameter (d') between about 25 mm and about 55 mm at the front end. The expansion chamber can comprise a diameter (d') between about 25 mm and about 50 mm at the front end. The expansion chamber can comprise a diameter (d') between about 25 mm and about 45 mm at the front end. The expansion chamber can comprise a diameter (d') between about 40 mm and about 45 mm at the front end. In some embodiments, the expansion chamber can comprise a diameter (d') of about 25 mm. The expansion chamber can comprise a diameter (d') of about 30 mm. The expansion chamber can comprise a diameter (d') of about 36 mm. The expansion chamber can comprise a diameter (d') of about 38 mm. The expansion chamber can comprise a diameter (d') of about 40 mm. The expansion chamber can comprise a diameter (d') of about 42 mm. The expansion chamber can comprise a diameter (d') of about 44 mm. The expansion chamber can comprise a diameter (d') of about 46 mm. The expansion chamber can comprise a diameter (d') of about 48 mm. The expansion chamber can comprise a diameter (d') of about 50 mm. The expansion chamber can comprise a diameter (d') of about 52 mm. The expansion chamber can comprise a diameter (d') of about 54 mm. The expansion chamber can comprise a diameter (d') of about 55 mm. In some aspects, the expansion chamber can comprise a diameter (d') of about 44 mm at the front end.

The expansion chamber can comprise a diameter (d) between about 10 mm and about 25 mm at the back end. The expansion chamber can comprise a diameter (d) between about 10 mm and about 20 mm at the back end. The expansion chamber can comprise a diameter (d) between about 15 mm and about 20 mm at the back end. In some embodiments, the expansion chamber can comprise a diameter (d) of about 10 mm. The expansion chamber can comprise a diameter (d) of about 12 mm. The expansion chamber can comprise a diameter (d) of about 14 mm. The expansion chamber can comprise a diameter (d) of about 16 mm. The expansion chamber can comprise a diameter (d) of about 18 mm. The expansion chamber can comprise a diameter (d) of about 20 mm. The expansion chamber can comprise a diameter (d) of about 22 mm. The expansion chamber can comprise a diameter (d) of about 24 mm. The expansion chamber can comprise a diameter (d) of or about 25 mm. The expansion chamber can comprise a diameter (d) of about 16 mm. The expansion chamber can comprise a diameter (d) of about 16.8 mm. The expansion chamber can comprise a diameter (d) of about 17 mm. The expansion chamber can comprise a diameter (d) of about 18 mm. The expansion chamber can comprise a diameter (d) of about 19 mm. The expansion chamber can comprise a diameter (d) of about 20 mm. In some aspects, the expansion chamber comprises a diameter (d) between about 16.8 mm and 20 mm at the back end.

The expansion chamber can comprise a difference between the diameter (d') at the front end and the diameter (d) at the back end (a ratio of d'/d). The ratio of d'/d can be between about 1.2 and about 5.5. The ratio of d'/d can be between about 1.2. The ratio of d'/d can be between about 1.5. The ratio of d'/d can be between about 2. The ratio of d'/d can be between about 2.5. The ratio of d'/d can be between about 3. The ratio of d'/d can be between about 3.5. The ratio of d'/d can be between about 4. The ratio of d'/d can be between about 4.5. The ratio of d'/d can be between about 5. The ratio of d'/d can be between about 5.5.

The expansion chamber can comprise a length from the front end to the back end of between about 40 cm and about 80 cm. The expansion chamber can comprise a length from the front end to the back end of between about 45 cm and about 75 cm. The expansion chamber can comprise a length from the front end to the back end of between about 50 cm and about 70 cm. The expansion chamber can comprise a length from the front end to the back end of between about 52 cm and about 70 cm. The expansion chamber can comprise a length from the front end to the back end of between about 54 cm and about 70 cm. The expansion chamber can comprise a length from the front end to the back end of between about 54 cm and about 65 cm. The expansion chamber can comprise a length from the front end to the back end of about 40 cm. The expansion chamber can comprise a length from the front end to the back end of about 45 cm. The expansion chamber can comprise a length from the front end to the back end of about 50 cm. The expansion chamber can comprise a length from the front end to the back end of about 55 cm. The expansion chamber can comprise a length from the front end to the back end of about 60 cm. The expansion chamber can comprise a length from the front end to the back end of about 65 cm. The expansion chamber can comprise a length from the front end to the back end of about 70 cm. The expansion chamber can comprise a length from the front end to the back end of about 75 cm. The expansion chamber can comprise a length from the front end to the back end of about 80 cm. In some aspects, the expansion chamber can comprise a length from the front end to the back end between about 54 cm and about 64 cm.

The Divergent Portion

The divergent portion (e.g., diffuser, divergent cone, or first tapering portion) can comprise a first and a second end. The first end of the divergent portion can be connected to the second end of divergent portion by a wall. The divergent portion can comprise a smaller width (e.g., diameter) at the first end of the divergent portion than at the second end of the divergent portion. The divergent portion at its first end can comprise the narrowest section of the divergent portion. The divergent portion at the second end can comprise the widest section of the divergent portion.

The wall connecting the first end of the divergent portion to the second end of divergent portion can be tapered. The wall can comprise the shape of a truncated cone side.

Figure 3A:
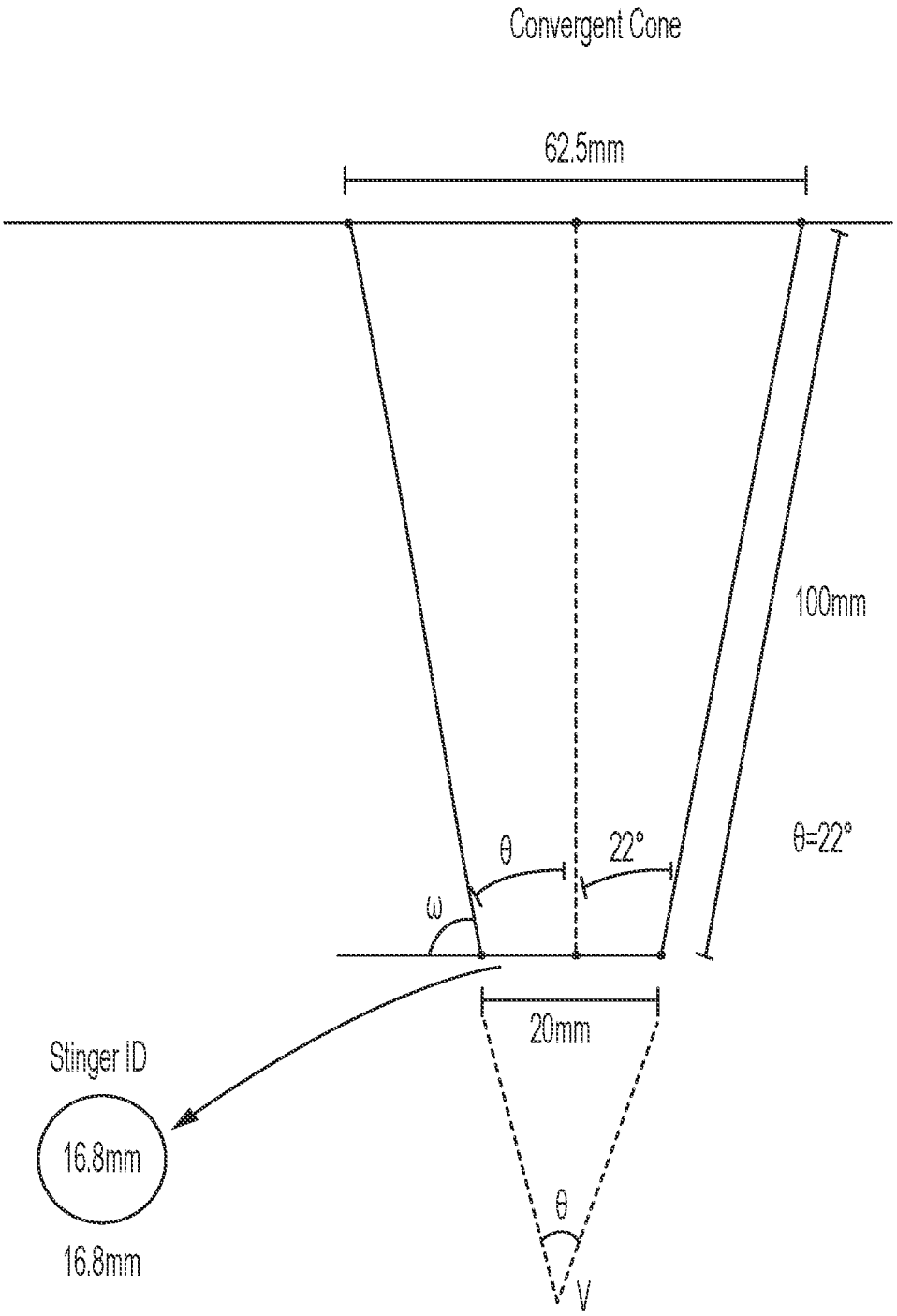
FIGS. 3A and 3B are diagrams depicting the convergent cone dimensions (FIG. 3A) and divergent cone dimensions (FIG. 3B) for one of the embodiments of the exhaust system.
Figure 3B:
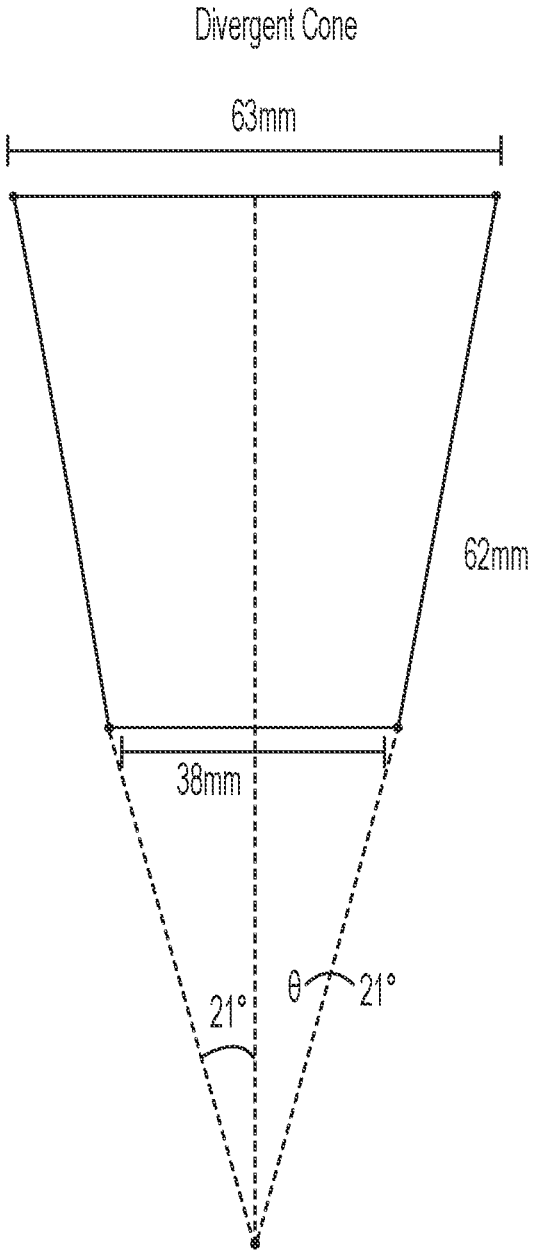

The divergent portion can have a truncated cone shape. The divergent portion can be a hollow truncated cone. The divergent portion can have a truncated cone shape comprising an angle (θ') at the vertex (V') of between about 15° and about 30°. The divergent portion at the vertex (V') can comprise an angle (θ') between about 20° and about 30°. The divergent portion at the vertex (V') can comprise an angle (θ') of about 22°. In some aspects, divergent portion at the vertex (V') can comprise an angle (θ') of about 20°, as shown in FIG. 3B.

The divergent portion can have a truncated cone shape comprising, at the narrowest section, an outer angle (ω') between about 30° and about 85°. The divergent portion can have a truncated cone shape comprising, at the narrowest section, an outer angle (ω') between about 40° and about 80°. The divergent portion can have a truncated cone shape comprising, at the narrowest section, an outer angle (ω') between about 50° and about 80°. The divergent portion can have a truncated cone shape comprising, at the narrowest section, an outer angle (ω') between about 60° and about 80°. The divergent portion can have a truncated cone shape comprising, at the narrowest section, an outer angle (ω') of about 30°. The divergent portion can have a truncated cone shape comprising, at the narrowest section, an outer angle (ω') of about 35°. The divergent portion can have a truncated cone shape comprising, at the narrowest section, an outer angle (ω') of about 40°. The divergent portion can have a truncated cone shape comprising, at the narrowest section, an outer angle (ω') of about 45°. The divergent portion can have a truncated cone shape comprising, at the narrowest section, an outer angle (ω') of about 50°. The divergent portion can have a truncated cone shape comprising, at the narrowest section, an outer angle (ω') of about 55°. The divergent portion can have a truncated cone shape comprising, at the narrowest section, an outer angle (ω') of about 60°. The divergent portion can have a truncated cone shape comprising, at the narrowest section, an outer angle (ω') of about 65°. The divergent portion can have a truncated cone shape comprising, at the narrowest section, an outer angle (ω') of about 70°. The divergent portion can have a truncated cone shape comprising, at the narrowest section, an outer angle (ω') of about 75°. The divergent portion can have a truncated cone shape comprising, at the narrowest section, an outer angle (ω') of about 80°.

The divergent portion, from the narrowest section to the widest section, can comprise a height between about 50 mm and about 80 mm. The divergent portion, from the narrowest section to the widest section, can comprise a height between about 55 mm and about 75 mm. The divergent portion, from the narrowest section to the widest section, can comprise a height between about 55 mm and about 70 mm. The divergent portion, from the narrowest section to the widest section, can comprise a height between about 55 mm and 65 mm. The divergent portion, from the narrowest section to the widest section, can comprise a height about 62 mm. The divergent portion, from the narrowest section to the widest section, can comprise a height or about 65 mm. In some aspects, the divergent portion, from the narrowest section to the widest section, can comprise a height of about 62 mm.

The divergent portion, from the narrowest section to the widest section, can be comprised of a single piece. The divergent portion, from the narrowest section to the widest section, can comprise two or more segments. The segments of the divergent portion can be welded together and comprise one or more welded joint(s). The welded joint(s) can be positioned perpendicular to the longitudinal axis of the divergent portion.

Cross-sections of the divergent portion can comprise different forms. For example, each cross-section may be circular, elliptical, have rounded form (e.g., not perfectly circular, having variations from a circular form).

The Belly

The belly can comprise a circumference between about 20 cm and about 50 cm and a diameter (D) between about 70 mm and about 150 mm. The belly can comprise a circumference between about 20 cm and about 45 cm. The belly can comprise a circumference between about 20 cm and about 40 cm. The belly can comprise a circumference between about 25 cm and about 45 cm. The belly can comprise a circumference between about 25 cm and about 40 cm. The belly can comprise a circumference between about 25 cm and about 35 cm. In some embodiments, the belly can comprise a circumference of about 25 cm. The belly can comprise a circumference of about 28 cm. The belly can comprise a circumference of about 30 cm. The belly can comprise a circumference of about 32 cm. The belly can comprise a circumference of about 34 cm. The belly can comprise a circumference of about 36 cm. The belly can comprise a circumference of about 38 cm. The belly can comprise a circumference of about 40 cm. The belly can comprise a circumference of about 42 cm. The belly can comprise a circumference of about 44 cm. The belly can comprise a circumference of about 46 cm. The belly can comprise a circumference of about 48 cm. The belly can comprise a circumference of about 50 cm. In some aspects, the belly can comprise a circumference of about 30 cm.

The belly can comprise a diameter (D) between about 70 mm and about 150 mm. The belly can comprise a diameter (D) between about 70 mm and about 140 mm. The belly can comprise a diameter (D) between about 70 mm and about 130 mm. The belly can comprise a diameter (D) between about 70 mm and about 120 mm. The belly can comprise a diameter (D) between about 80 mm and about 150 mm. The belly can comprise a diameter (D) between about 80 mm and about 140 mm. The belly can comprise a diameter (D) between about 80 mm and about 130 mm. The belly can comprise a diameter (D) between about 80 mm and about 120 mm. The belly can comprise a diameter (D) between about 90 mm and about 110 mm. In some embodiments, the belly can comprise a diameter (D) of about 70 mm. The belly can comprise a diameter (D) of about 80 mm. The belly can comprise a diameter (D) of about 90 mm. The belly can comprise a diameter (D) of about 100 mm. The belly can comprise a diameter (D) of about 110 mm. The belly can comprise a diameter (D) of about 120 mm. The belly can comprise a diameter (D) of about 130 mm. The belly can comprise a diameter (D) of about 140 mm. The belly can comprise a diameter (D) of about 150 mm. In some aspects, the belly can comprise a diameter (D) of about 100 mm.

The Convergent Portion

The convergent portion (e.g., baffle cone, convergent cone, or second tapering portion) can comprise a first end and a second end. The first end of the convergent portion can be connected to the second end of convergent portion by a wall. The convergent portion can comprise a larger width (e.g., diameter) at the first end of the convergent portion than at the second end of the convergent portion. The convergent portion at its first end can comprise the widest section of the convergent portion. The convergent portion at the second end can comprise the narrowest section of the convergent portion.

The wall connecting the first end of the convergent portion to the second end of convergent portion can be tapered. The wall can comprise the shape of a truncated cone side.

The convergent portion can have a truncated cone shape. The convergent portion can be a hollow truncated cone. The convergent portion can have a truncated cone shape comprising an angle (θ) at the vertex (V) of between about 15° and about 30°. The convergent portion at the vertex (V) can comprise an angle (θ) between about 20° and about 30°. The convergent portion at the vertex (V) can comprise an angle (θ) of about 22°. In some aspects, convergent portion at the vertex (V) can comprise an angle (θ) of about 22°, as shown in FIG. 3A.

The convergent portion can have a truncated cone shape comprising, at the narrowest section, an outer angle (ω) between about 35° and about 85°. The convergent portion can have a truncated cone shape comprising, at the narrowest section, an outer angle (ω) between about 40° and about 80°. The convergent portion can have a truncated cone shape comprising, at the narrowest section, an outer angle (ω) between about 50° and about 80°. The convergent portion can have a truncated cone shape comprising, at the narrowest section, an outer angle (ω) between about 60° and about 80°. The convergent portion can have a truncated cone shape comprising, at the narrowest section, an outer angle (ω) of about 80°. In some aspects, the convergent portion can have a truncated cone shape comprising, at the narrowest section an outer angle (ω) of about 79°.

The convergent portion, from the narrowest section to the widest section, can comprise a height between about 80 mm and about 120 mm. The convergent portion, from the narrowest section to the widest section, can comprise a height between about 85 mm and about 115 mm. The convergent portion, from the narrowest section to the widest section, can comprise a height between about 85 mm and about 110 mm. The convergent portion, from the narrowest section to the widest section, can comprise a height between about 85 mm and about 105 mm. The convergent portion, from the narrowest section to the widest section, can comprise a height between about 90 mm and about 105 mm. The convergent portion, from the narrowest section to the widest section, can comprise a height between about 95 mm and about 105 mm. The convergent portion, from the narrowest section to the widest section, can comprise a height of about 100 mm.

The convergent portion, from the narrowest section to the widest section, can be comprised of a single piece. The convergent portion, from the narrowest section to the widest section, can be comprised of two or more segments. The segments of the convergent portion can be welded together and comprise one or more welded joint(s). The welded joint(s) can be positioned perpendicular to the longitudinal axis of the convergent portion.

Cross-sections of the convergent portion can comprise different forms. For example, each cross-section of the convergent portion may be circular, elliptical, have rounded form (e.g., not perfectly circular, having variations from a circular form).

The Bracket

The exhaust system can comprise a bracket. The bracket can comprise a flat bar extending outwards from the exhaust system. The flat bar can comprise a length between about 5 cm and about 50 cm. The flat bar can comprise a length between about 10 cm and about 40 cm. The flat bar can comprise a length between about 10 cm and about 30 cm. The flat bar can comprise a length of about 5 cm. The flat bar can comprise a length of about 10 cm. The flat bar can comprise a length of about 15 cm. The flat bar can comprise a length of about 20 cm. The flat bar can comprise a length of about 25 cm. The flat bar can comprise a length of about 30 cm. The flat bar can comprise a length of about 35 cm. The flat bar can comprise a length of about 40 cm. The flat bar can comprise a length of about 45 cm. The flat bar can comprise a length of about 50 cm. In some aspects, the flat bar can comprise a length between about 10 cm and about 30 cm.

The Stinger

The exhaust system can comprise a stinger. The stinger can comprise a straight hollow tube. The stinger can comprise a straight hollow tube having a length between about 2 cm and about 25 cm. The stinger can comprise a length between about 2 cm and about 25 cm. The stinger can comprise a length between about 2 cm and about 22 cm. The stinger can comprise a length between about 5 cm and about 22 cm. The stinger can comprise a length between about 10 cm and about 22 cm. The stinger can comprise a length between about 10 cm and about 20 cm. The stinger can comprise a length between about 10 cm and 18 cm. The stinger can comprise a length between about 10 cm and about 15 cm. The stinger can comprise a length of about 2 cm. The stinger can comprise a length of about 4 cm. The stinger can comprise a length of about 6 cm. The stinger can comprise a length of about 8 cm. The stinger can comprise a length of about 10 cm. The stinger can comprise a length of about 12 cm. The stinger can comprise a length of about 14 cm. The stinger can comprise a length of about 16 cm. The stinger can comprise a length of about 18 cm. The stinger can comprise a length of about 20 cm. The stinger can comprise a length of about 22 cm. The stinger can comprise a length of about 25 cm. In some aspects, the stinger can comprise a length of about 14 cm.

The stinger can comprise an inner diameter. The stinger can comprise an inner diameter between about 10 mm and about 25 mm. The stinger can comprise an inner diameter of about 10 mm. The stinger can comprise an inner diameter of about 12 mm. The stinger can comprise an inner diameter of about 14 mm. The stinger can comprise an inner diameter of about 16 mm. The stinger can comprise an inner diameter of about 18 mm. The stinger can comprise an inner diameter of about 20 mm. The stinger can comprise an inner diameter of about 22 mm. The stinger can comprise an inner diameter of about 24 mm. The stinger can comprise an inner diameter of about 15 mm. The stinger can comprise an inner diameter of about 16 mm. The stinger can comprise an inner diameter of about 16.8 mm. The stinger can comprise an inner diameter of about 17 mm. The stinger can comprise an inner diameter of about 18 mm. The stinger can comprise an inner diameter of about 19 mm. The stinger can comprise an inner diameter of about 20 mm. The stinger can comprise an inner diameter of about 22 mm. The stinger can comprise an inner diameter of about 24 mm. In some aspects, the stinger can comprise an inner diameter between about 16.8 mm and about 20 mm. The stinger can comprise the same inner diameter along the longitudinal axis of the stinger.

Also provided are exhaust systems comprising

- a header comprising a length of about 12.5 cm and an inner diameter of about 28 mm;
- an expansion chamber comprising a length of about 54 cm and a diameter of about 100 mm and a circumference of about 300 mm at about the center of the expansion chamber; and
- a stinger comprising a length of about 14 cm and an inner diameter of about 16.8 mm.

The disclosed exhaust systems can comprise a length between about 60 cm and about 175 cm from the first end of the exhaust systems to the second end of the exhaust systems. In some aspects, the disclosed exhaust systems comprise a length of about 100 cm from the first end of the exhaust systems to the second end of the exhaust systems.

One example of the disclosed exhaust systems is presented in FIG. 1. The exhaust system 100 includes a flange 10 at the first end of the exhaust system 100. The flange 10 is adjacent to the header 20. The header 20 is followed by a curved portion 30. The curved portion 30 is connected to the expansion chamber 40 comprising a front end 42 and a back end 44. The expansion chamber 40 is adjacent to the curved portion 30 at the front end 42. The expansion chamber 40 is adjacent to a stinger 50 at the back end 44 of the expansion chamber 40.

The expansion chamber 40 includes a divergent cone 46 at the front end 42, a belly 45 about the center of the expansion chamber 40, and a convergent cone 48 at the back end 44. A bracket 60 is attached to the stinger 50 of the exhaust system 100.

Figure 2:
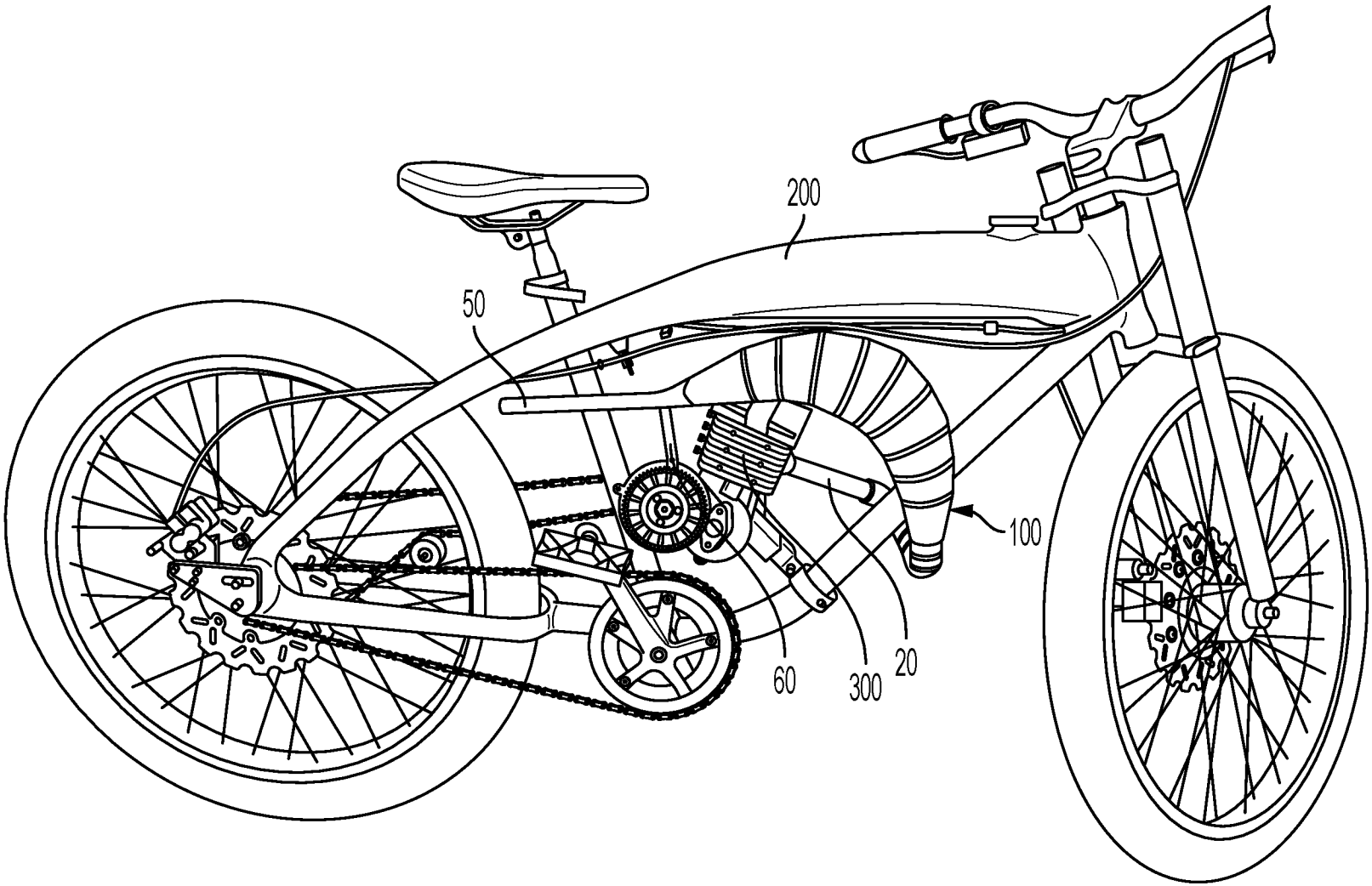
FIG. 2 is a diagram depicting the stainless-steel exhaust system 100 attached to a motorized bicycle 200.

After attachment to an exhaust port of a two-stroke engine mounted on a bicycle, the front end 42 of the expansion chamber 40 is the lowermost points of the exhaust system 100 relative to the engine, as shown in FIG. 2. FIG. 2 is a diagram depicting the stainless-steel exhaust system 100 attached to a motorized bicycle 200 via the bracket 60 and to a two-stroke internal combustion engine 300 via at the header 20 (the flange is not visible) of the exhaust system 100. The two-stroke internal combustion engine 300 is also attached to the motorized bicycle 200.

Figure 5:
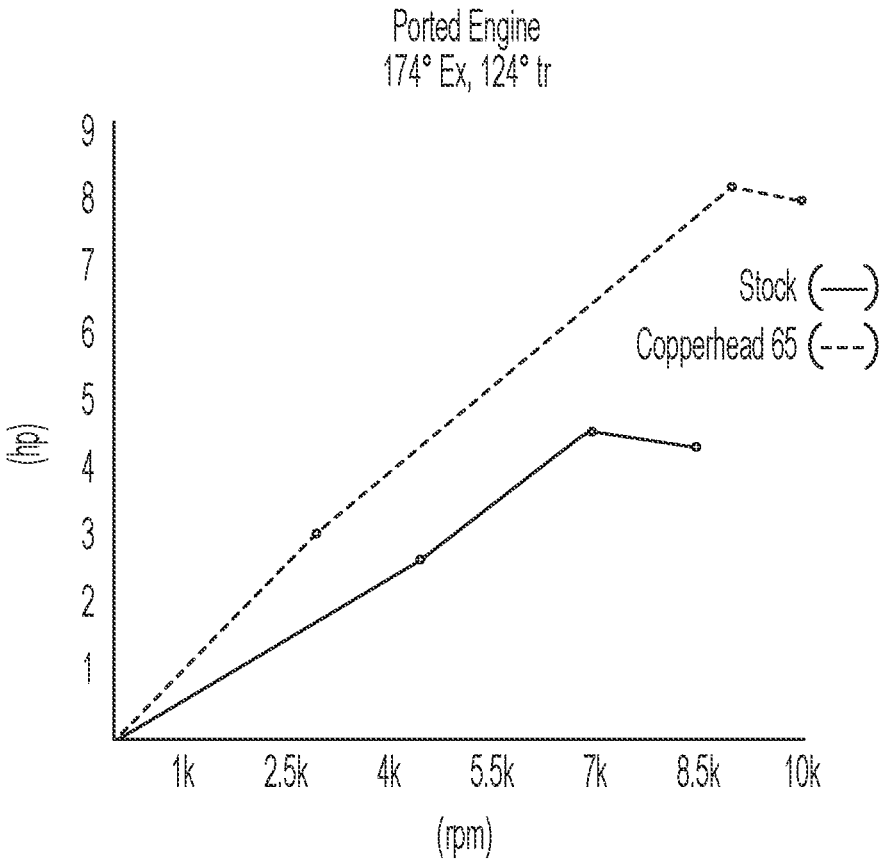
FIG. 5 is a graph depicting changes in horsepower (hp) over rpm (×1000) for two exhaust systems: a stock pipe (solid line), and an exhaust system according to one embodiment (Copperhead 65, dashed line) of the exhaust systems with an engine having 174 degrees of exhaust timing and 124 degrees of transfer timing.

The disclosed exhaust systems are distinguishable because of their multi-piece design and smaller stinger when compared to other exhaust systems. The smaller inner diameter stinger works by spreading the powerband of the engine across a wider range. That is, the power curve of the engine begins in the 3,000 RPM range and ends at the 10,000 RPM range, as shown in FIG. 5. In addition to the smaller inner diameter stinger, the disclosed exhaust systems use the maximum size front pipe (header) to accommodate optimum exhaust expulsion and increased pressure of the return wave going back into the engine.

The distance from the pistons of the two-stroke engine to the various points in the exhaust system can be established by measuring from the side of the piston facing the exhaust port—commonly referred to as the piston face—to various points on the exhaust system. The measured distance can provide information about performance specific to the engine in question. Based on a given two-stroke engine's port timing, an exhaust system's tuned length should fall within an acceptable range. The tuned length refers to the distance from the piston face to the very end of the convergent cone where the stinger begins. An exhaust system that is generally shorter will allow an engine to reach the maximum RPM, sometimes at the expense of low-end power. Alternatively, an exhaust system that is longer will favor an engine that produces more low-end power, sometimes at the expense of higher RPM. Tuned length should work in tandem with the inner diameter of the exhaust system. While others have found that the outlet pipe (stinger) should have an inner diameter of 0.58 to 0.62 times that of the lead pipe (header), achieving the proper header diameter-to-stinger diameter ratio and tuned length is important to improve the power curve of the engine and to have it spin as fast as it was intended to.

The disclosed exhaust systems can comprise a header diameter-to-stinger diameter ratio (29 mm header and 17 mm stinger) of about 0.58. By comparison, other available exhaust systems, such as stock exhaust pipes and expansion chamber mufflers, offer a header that has a 19.2 mm inner diameter and a stinger that has 25 mm inner diameter. Testing these revealed that their header-to-stinger ratio makes it nearly impossible to benefit from the return wave and thereby fail to produce a power band.

Methods of Making the Exhaust Systems

The disclosed exhaust systems can be manufactured using mild steel, stainless steel, titanium alloys, or nickel alloys.

The exhaust systems can be manufactured using available methods, such as molding, stamping, cutting, and/or welding.

Methods of Using the Exhaust Systems

The disclosed exhaust systems can be fitted onto a bicycle equipped with a two-stroke engine, as shown in FIG. 2. The exhaust systems include a flange or a port that directly attaches to the exhaust ports of two-stroke engines. For example, the disclosed exhaust systems can comprise a flange that is directly mounted onto the exhaust port of a two-stroke engine. A bracket attaches the stinger of the exhaust system to bicycle.

The bicycle can comprise a road bicycle, a cruising bicycle, a mountain bicycle, or a combination thereof. In some aspects, the bicycle does not comprise a dirt bicycle.

The disclosed exhaust systems can comprise a flexible header and side mount systems to address some of the past challenges:

1) The header can be a slip fit with springs. This feature allows all engine vibrations on the exhaust system to be effectively absorbed by springs.
2) A side mount system can comprise two pieces. This can allow for all custom mounting applications and durability.

The straight header and the curved portion can be segmented. The straight header and the curved portion can comprise two or more segments. These segments are referred to as pie-cuts and are used to allow the exhaust system to fit the bike frame and engine precisely.

In some embodiments, the exhaust system is bolted onto the exhaust port of a China Doll engine, such as China Doll PK80 66 cc/80 cc engine, and wraps around the down tube of the bicycle frame. It may also be mounted on the side of the engine (e.g., bolted through clutch cover) using a secondary mounting tab. In some embodiments, the exhaust system can be attached to the exhaust port of a 70 cc hybrid engine. The bicycles used in these applications can be mountain bikes, beach cruisers and Felt Faker style in-frame gas tank bicycles. The engines may be mounted to the bicycle down tube and seat tubes using either built-in engine mounts or with a front mount that provides additional mounting strength for higher horsepower applications. After attachment to an exhaust port of a two-stroke engine mounted on a bicycle, the front end of the expansion chamber is the lowermost points of the exhaust system relative to the engine.

The disclosed exhaust systems can improve the power (e.g., horsepower, hp) of a two-stroke engine. In some embodiments, the power of a two-stroke engine can be increased from about 15% to about 85% when compared to the power of the two-stroke engine with an exhaust pipe. In some embodiments, the power (horsepower, hp) of a two-stroke engine can be increased from about 15% to about 85% when compared to the power of the two-stroke engine with an exhaust pipe, such as a stock exhaust pipe, at RPM between about 3,000 and 9,000.

In some aspects, the power of a two-stroke engine can be increased by greater than about 15% when compared to the power of the two-stroke engine with an exhaust pipe, such as a stock exhaust pipe, at 3,000 RPM. The power of a two-stroke engine can be increased by greater than about 20% when compared to the power of the two-stroke engine with an exhaust pipe, such as a stock exhaust pipe, at 3,000 RPM. The power of a two-stroke engine can be increased by greater than about 30% when compared to the power of the two-stroke engine with an exhaust pipe, such as a stock exhaust pipe, at 3,000 RPM. The power of a two-stroke engine can be increased by greater than about 40% when compared to the power of the two-stroke engine with an exhaust pipe, such as a stock exhaust pipe, at 3,000 RPM. The power of a two-stroke engine can be increased by greater than about 50% when compared to the power of the two-stroke engine with an exhaust pipe, such as a stock exhaust pipe, at 3,000 RPM. The power of a two-stroke engine can be increased by greater than about 60% when compared to the power of the two-stroke engine with an exhaust pipe, such as a stock exhaust pipe, at 3,000 RPM. The power of a two-stroke engine can be increased by greater than about 70% when compared to the power of the two-stroke engine with an exhaust pipe, such as a stock exhaust pipe, at 3,000 RPM. The power of a two-stroke engine can be increased by greater than about 80% when compared to the power of the two-stroke engine with an exhaust pipe, such as a stock exhaust pipe, at 3,000 RPM.

In some aspects, the power of a two-stroke engine can be increased by greater than about 15% when compared to the power of the two-stroke engine with an exhaust pipe, such as a stock exhaust pipe, at 9,000 RPM. The power of a two-stroke engine can be increased by greater than about 20% when compared to the power of the two-stroke engine with an exhaust pipe, such as a stock exhaust pipe, at 9,000 RPM. The power of a two-stroke engine can be increased by greater than about 30% when compared to the power of the two-stroke engine with an exhaust pipe, such as a stock exhaust pipe, at 9,000 RPM. The power of a two-stroke engine can be increased by greater than about 40% when compared to the power of the two-stroke engine with an exhaust pipe, such as a stock exhaust pipe, at 9,000 RPM. The power of a two-stroke engine can be increased by greater than about 50% when compared to the power of the two-stroke engine with an exhaust pipe, such as a stock exhaust pipe, at 9,000 RPM. The power of a two-stroke engine can be increased by greater than about 60% when compared to the power of the two-stroke engine with an exhaust pipe, such as a stock exhaust pipe, at 9,000 RPM. The power of a two-stroke engine can be increased by greater than about 70% when compared to the power of the two-stroke engine with an exhaust pipe, such as a stock exhaust pipe, at 9,000 RPM. The power of a two-stroke engine can be increased by greater than about 80% when compared to the power of the two-stroke engine with an exhaust pipe, such as a stock exhaust pipe, at 9,000 RPM.

Aspects

Aspect 1. An exhaust system comprising a first end and a second end, and:

a flange at the first end of the exhaust system;

a header adjacent to the flange;

a curved portion adjacent to the header;

an expansion chamber comprising a front end and a back end, wherein the expansion chamber is adjacent to the curved portion at the front end; and a stinger adjacent to the back end of the expansion chamber;

wherein the expansion chamber comprises a divergent portion at the front end, a belly about the center of the expansion chamber, and a convergent portion at the back end, and wherein the convergent portion has a truncated cone shape and an angle ($\theta$) at the vertex (V) of between about 15° and about 30°.

Aspect 2. The exhaust system of aspect 1, wherein the header comprises a hollow tube having a length of about 25 cm or less.

Aspect 3. The exhaust system of aspect 1 or 2, wherein the header comprises a length between about 5 cm and about 25 cm.

Aspect 4. The exhaust system of any one of aspects 1-3, wherein the header comprises an inner diameter between about 25 mm and about 50 mm.

Aspect 5. The exhaust system of any one of aspects 1-4, wherein the curved portion is segmented.

Aspect 6. The exhaust system of any one of aspects 1-5, wherein the curved portion has a length between about 20 cm and about 50 cm and an inner diameter substantially the same as the inner diameter of the header.

Aspect 7. The exhaust system of any one of aspects 1-6, wherein the divergent portion has a truncated cone shape and an angle (θ') at the vertex (V') of between about 15° and about 30°.

Aspect 8. The exhaust system of any one of aspects 1-7, wherein the divergent portion comprises a truncated cone shape having a height from the narrowest section to the widest section of between about 50 mm and 80 mm.

Aspect 9. The exhaust system of any one of aspects 1-8, wherein the belly has a circumference between about 20 cm and about 50 cm and a diameter (D) between about 70 mm and about 150 mm.

Aspect 10. The exhaust system of any one of aspects 1-9, wherein the convergent portion at the narrowest section has an outer angle (ω) between about 35° and about 85°.

Aspect 11. The exhaust system of any one of aspects 1-10, wherein the convergent portion from the narrowest section to the widest section has a height between about 80 mm and 120 mm.

Aspect 12. The exhaust system of any one of aspects 1-11, wherein the expansion chamber is segmented.

Aspect 13. The exhaust system of any one of aspects 1-12, wherein the expansion chamber is segmented comprising multiple segments welded together.

Aspect 14. The exhaust system of any one of aspects 1-13, wherein the expansion chamber comprises a diameter (d') between about 25 mm and about 55 mm at the front end.

Aspect 15. The exhaust system of any one of aspects 1-14, wherein the expansion chamber comprises a diameter (d) between about 10 mm and about 25 mm at the back end.

Aspect 16. The exhaust system of any one of aspects 1-15, wherein the expansion chamber comprises a difference between the diameter (d') at the front end and the diameter (d) at the back end (a ratio d'/d) between about 1.2 and about 5.5.

Aspect 17. The exhaust system of any one of aspects 1-16, wherein the expansion chamber comprises a length between about 40 cm and about 80 cm.

Aspect 18. The exhaust system of any one of aspects 1-17, further comprising a bracket linked to the stinger, wherein the bracket is a flat bar that extends outwards from the exhaust system.

Aspect 19. The exhaust system of aspect 18, wherein the flat bar has a length between about 5 cm and about 50 cm.

Aspect 20. The exhaust system of any one of aspects 1-19, wherein the stinger comprises a hollow tube having a length between about 2 cm and about 25 cm.

Aspect 21. The exhaust system of any one of aspects 1-20, wherein the stinger comprises a hollow tube having a diameter between about 10 mm and about 35 mm.

Aspect 22. The exhaust system of any one of aspects 1-21, wherein:

the header comprises a length of about 12.5 cm and an inner diameter of about 28 mm;

the expansion chamber has a length of about 54 cm, a diameter of about 100 mm and a circumference of about 300 mm at about the center; and the stinger comprises a length of about 14 cm and an inner diameter of about 17 mm.

Aspect 23. The exhaust system of any one of aspects 1-22, comprising a length of between about 60 cm and about 175 cm from the first end to the second end.

Aspect 24. A method comprising attaching to an exhaust port of a two-stroke engine an exhaust system comprising a first end and a second end, and:

a flange at the first end of the exhaust system;

a header adjacent to the flange;

a curved portion adjacent to the header;

an expansion chamber comprising a front end and a back end, wherein the expansion chamber is adjacent to the curved portion at the front end; and a stinger adjacent to the back end of the expansion chamber;

wherein the expansion chamber comprises a divergent portion at the front end, a belly about the center of the expansion chamber, and a convergent portion at the back end, and wherein the convergent portion has a truncated cone shape and an angle (θ) at the vertex (V) of between about 15° and about 30°.

Aspect 25. The method of aspect 24, wherein attaching comprises linking the flange of the exhaust system to the exhaust port of the two-stroke engine.

Aspect 26. The method of aspect 24 or 25, wherein the two-stroke engine is mounted on a bicycle.

Aspect 27. The method of any one of aspects 24-26, wherein horsepower of the two-stroke engine is increased from about 15% to about 85% when compared to the power of the two-stroke engine with an exhaust pipe.

Aspect 28. The method of any one of aspects 24-27, wherein horsepower of the two-stroke engine is increased by greater than about 80% when compared to the horsepower of the two-stroke engine with an exhaust pipe and operating at about 3,000 RPM.

Aspect 29. The method of any one of aspects 24-28, wherein horsepower of the two-stroke engine is increased by greater than about 80% when compared to the horsepower of the two-stroke engine with an exhaust pipe and operating at about 9,000 RPM.

Aspect 30. The method of any one of aspects 24-29, wherein the two-stroke engine is PK80 66 cc/80 cc engine or a 70 cc hybrid engine.

EXAMPLES

Example 1. Improved Performance of a Two-Stroke Engine with the Use of the Disclosed Exhaust System Materials and Methods An exhaust system with specific dimensions was built and tested for engine performance in silico modeling as well as in practice.

A freely available software permits calculating the engine performance at specific exhaust and transfer timings with exhaust systems of various designs and dimensions. The software permits calculating horsepower output at specific revolutions per minute (RPM) for exhaust systems of different dimensions.

The disclosed exhaust systems include length of the header that provides maximum performance for two-stroke engines. A header that is too long might not allow an engine with higher degrees of exhaust timing to reach the maximum RPM. A header that is too short might not reach powerband on an engine that has lower degrees of exhaust timing. The disclosed exhaust systems are designed to allow a China Doll PK80 66 cc/80 cc engine to spin up to 10,000 rpm and provide a strong, broad powerband (i.e., longer duration of acceleration) between 3,500 rpm and 9,000 rpm.

A China Doll engine port timing ranges from 165 degrees to175 degrees of exhaust timing; and from 120 degrees to 126 degrees of transfer timing. Obtaining the timing of a two-stroke engine requires the use of a degree wheel. The degree wheel is bolted onto the engine crankshaft and measures the degrees of rotation and thus piston position with the cylinder. Exhaust timing refers to the amount of time (measured in degrees on degree wheel) it takes for the piston to completely open and close the exhaust port opening. The same applies for the intake and transfer ports.

Results

Figure 4:
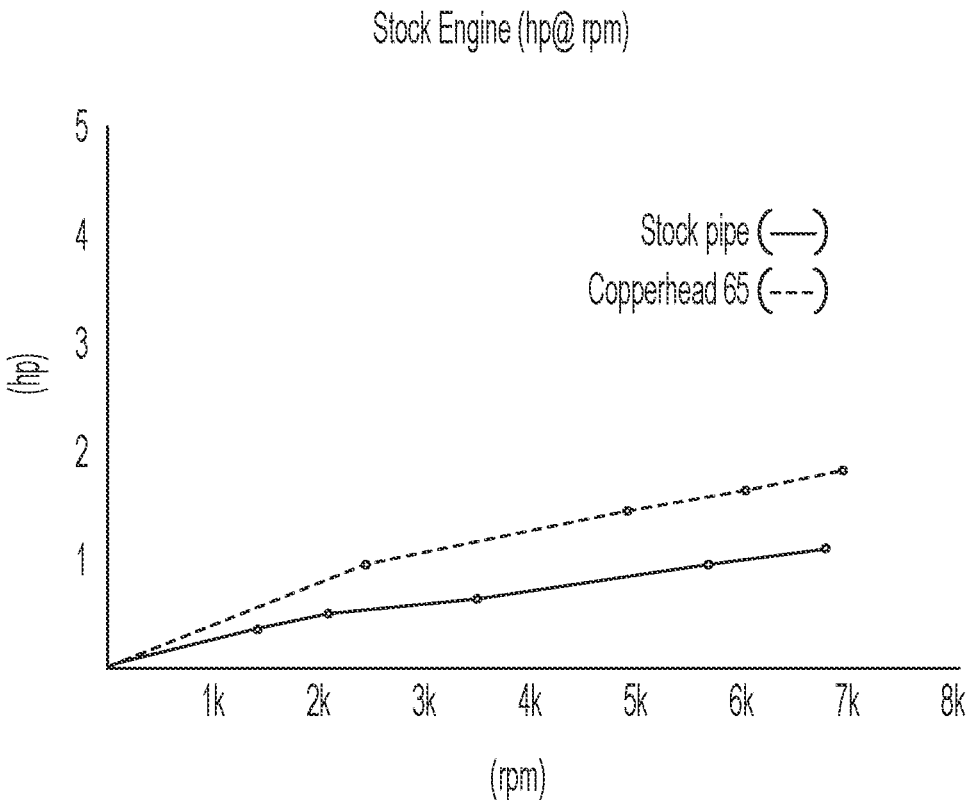
FIG. 4 is a graph depicting changes in horsepower (hp) over rpm (×1000) for two exhaust systems: a stock pipe (solid line), and an exhaust system according to one embodiment (named herein as "Copperhead 65", dashed line) of the exhaust systems.

The addition of a proper exhaust system increases volumetric efficiency. The exhaust pipes that come with China Doll engine kits are nothing more than a header tube approximately 30 cm long with an inner diameter of 20 mm, connected to a highly restrictive muffler that is approximately 25 cm long with an inner diameter of 50 mm. The disclosed expansion chamber was designed using a smaller diameter convergent cone than in other expansion chambers, which allowed for a smaller inner diameter stinger section. That smaller inner diameter stinger allowed for an increase in back pressure compared to other products. The increase in back pressure resulted in more overall horsepower and a broader, smoother engine power band. In a stock engine, e.g., China Doll, with no port work (increasing the size of exhaust, intake and/or transfer ports as well as increasing or decreasing the degrees of exhaust, intake and/or transfer duration), the disclosed exhaust system provided a power increase of between 15 percent to 50 percent. With an engine that had been properly ported, the exhaust system provided a power increase of between 15 percent and 85 percent compared to a stock "kit" muffler (FIG. 4 and FIG. 5). In addition to horsepower increases (per test), the shape of the power curve of the engine using the disclosed exhaust system is different from that achieved by other products and stock muffler.

The disclosed exhaust systems improve the performance of a two-stroke engine mounted on a bicycle in ways that perming sustained power during cycling and prevent prematurely wearing out the engine crank seals and the clutch:

1. The exhaust chamber includes a smaller inner diameter (16.8 mm) straight stinger than what is available (19+ mm).
2. The smaller diameter straight stinger has the effect of smoothing the powerband or rather allowing the engine to produce linear power as opposed to a quadratic or exponential power.
3. Linear power, while providing enormous acceleration, limits erratic acceleration (e.g., 2800 rpm to 5000 rpm) that often prematurely wears clutch components and engine crank seals.
4. Comparatively, a smaller inner diameter straight stinger pushes the RPM range slightly higher which results in achieving higher top speeds.

What is claimed:

1. An exhaust system for a two stroke engine of 66 cc/80 cc or a 70 cc hybrid engine comprising a first end and a second end, and comprising, in sequential order:

a flange at the first end of the exhaust system;

a header adjacent to the flange;

a curved portion adjacent to the header;

an expansion chamber comprising a front end and a back end, wherein the expansion chamber is adjacent to the curved portion at the front end; and a stinger extending from the back end of the expansion chamber;

wherein the expansion chamber comprises a hollow chamber comprising a divergent portion at the front end, a belly about the center of the expansion chamber, and a convergent portion at the back end, and wherein the convergent portion has a truncated cone shape and an angle (θ) at the vertex (V) of between about 15° and about 30° and a height greater than the height of the divergent portion.

2. The exhaust system of claim 1, wherein the header comprises a hollow tube having a length of about 25 cm or less.

3. The exhaust system of claim 1, wherein the header comprises a length between about 5 cm and about 25 cm.

4. The exhaust system of claim 1, wherein the header comprises an inner diameter between about 25 mm and about 50 mm.

5. The exhaust system of claim 1, wherein the curved portion is segmented.

6. The exhaust system of claim 1, wherein the curved portion has a length between about 20 cm and about 50 cm and an inner diameter substantially the same as the inner diameter of the header.

7. The exhaust system of claim 1, wherein the divergent portion has a truncated cone shape and an angle (θ') at the vertex (V') of between about 15° and about 30°.

8. The exhaust system of claim 1, wherein the divergent portion comprises a truncated cone shape having a height from the narrowest section to the widest section of between about 50 mm and 80 mm.

9. The exhaust system of claim 1, wherein the belly has a circumference between about 20 cm and about 50 cm and a diameter (D) between about 70 mm and about 150 mm.

10. The exhaust system of claim 1, wherein the convergent portion at the narrowest section has an outer angle (ω) between about 35° and about 85°.

11. The exhaust system of claim 1, wherein the convergent portion from the narrowest section to the widest section has a height between about 80 mm and 120 mm.

12. The exhaust system of claim 1, wherein the expansion chamber is segmented.

13. The exhaust system of claim 1, wherein the expansion chamber is segmented comprising multiple segments welded together.

14. The exhaust system of claim 1, wherein the expansion chamber comprises a diameter (d') between about 25 mm and about 55 mm at the front end.

15. The exhaust system of claim 1, wherein the expansion chamber comprises a diameter (d) between about 10 mm and about 25 mm at the back end.

16. The exhaust system of claim 1, wherein the expansion chamber comprises a difference between a diameter (d') at the front end and a diameter (d) at the back end (a ratio d'/d) between about 1.2 and about 5.5.

17. The exhaust system of claim 1, wherein the expansion chamber comprises a length between about 40 cm and about 80 cm.

18. The exhaust system of claim 1, further comprising a bracket adjacent to the stinger, wherein the bracket is a flat bar that extends outwards from the exhaust system.

19. The exhaust system of claim 18, wherein the flat bar has a length between about 5 cm and about 50 cm.

20. The exhaust system of claim 1, wherein the stinger comprises a hollow tube having a length between about 2 cm and 25 cm.

21. The exhaust system of claim 1, wherein the stinger comprises a hollow tube having a diameter between about 10 mm and about 35 mm.

22. The exhaust system of claim 1, wherein:

the header comprises a length of about 12.5 cm and an inner diameter of about 28 mm;

the expansion chamber has a length of about 54 cm and a diameter of about 100 mm and a circumference of about 300 mm at about the center; and the stinger comprises a length of about 14 cm and an inner diameter of about 17 mm.

23. The exhaust system of claim 1, comprising a length of between about 60 cm and about 175 cm from the first end to the second end.

24. A method comprising attaching to an exhaust port of a two-stroke engine of 66 cc/80 cc or a 70 cc hybrid engine an exhaust system comprising a first end and a second end, and comprising, in sequential order:

a flange at the first end of the exhaust system;

a header adjacent to the flange;

a curved portion adjacent to the header;

an expansion chamber comprising a front end and a back end, wherein the expansion chamber is adjacent to the curved portion at the front end; and a stinger extending from the back end of the expansion chamber;

wherein the expansion chamber comprises a hollow chamber comprising a divergent portion at the front end, a belly about the center of the expansion chamber, and a convergent portion at the back end, and wherein the convergent portion has a truncated cone shape and an angle (θ) at the vertex (V) of between about 15° and about 30° and a height greater than the height of the divergent portion.

25. The method of claim 24, wherein attaching comprises linking the flange of the exhaust system to the exhaust port of the two-stroke engine.

26. The method of claim 24, wherein the two-stroke engine is mounted on a bicycle.

* * * * *